United States Patent [19]

Smith

[11] 4,083,150

[45] Apr. 11, 1978

[54] DOOR CONSTRUCTION

[76] Inventor: Wesley A. Smith, Drummond Island, Mich. 49726

[21] Appl. No.: 714,049

[22] Filed: Aug. 13, 1976

[51] Int. Cl.[2] ..... E05F 1/00

[52] U.S. Cl. ..... 49/387; 49/200; 49/390

[58] Field of Search ..... 49/200, 199, 197, 203, 49/204, 205, 206, 390, 387, 71; 52/625

[56] References Cited

U.S. PATENT DOCUMENTS

| | | | |
|---|---|---|---|
| 2,067,623 | 1/1937 | Smith | 49/390 |
| 2,601,565 | 6/1952 | Smith | 49/387 |
| 2,863,181 | 12/1958 | Josephson | 49/387 |
| 3,092,171 | 6/1963 | Deddo | 49/71 X |

FOREIGN PATENT DOCUMENTS

| | | | |
|---|---|---|---|
| 1,017,058 | 9/1952 | France | 49/387 |
| 1,223,855 | 3/1971 | United Kingdom | 49/197 |

*Primary Examiner*—Philip C. Kannan

*Attorney, Agent, or Firm*—Blanchard, Flynn, Thiel, Boutell & Tanis

[57] ABSTRACT

An improved, one piece, counterbalanced, canopy-type door. The door has a counterweight tube fixed to and extending along the upper edge thereof, which tube contains a counterweight mass. The counterweight tube projects outwardly beyond the front surface of the door to provide for a positive closing of the door when the door swingably approaches its closed position. The door inlcudes a frame having a pair of Z-shaped rails defining the side edges of the door, and one or more intermediate channel members disposed between and substantially parallel to the side rails. The side rails and channel members are fixed at the upper ends thereof to the counterweight tube, and are of decreasing cross-section as they extend to the lower end of the door. This permits the door to be of lighter weight yet possess increased strength so that the door is capable of withstanding substantially greater panel loads thereon, such as caused by high winds.

15 Claims, 15 Drawing Figures

DOOR CONSTRUCTION

FIELD OF THE INVENTION

This invention relates to an improved canopy or cantilever-type door construction adaptable for use as a garage door, hanger door or the like, which door is adapted for installation and use where there is a minimum of head room, where a minimum of manual force is required to open and/or close the door, wherein adjustability in the location of the hinge axis is provided, and wherein the door is adaptable to operation by mechanical or electromechanical operators.

BACKGROUND OF THE INVENTION

There are many well established advantages of counterbalanced canopy-type closure members, such as garage doors, which advantages include simplicity of installation and operation, easy opening and closing, absence of complicated space consuming support structure, and the automatic weather shield provided by the door when in an open position. However, the usual construction of these doors also gives rise to certain structural and operational problems which have prevented doors of this type from operating in the most desirable manner.

One of the primary problems confronted by designers of one-piece canopy doors has been the difficulty of providing a door having the desired strength and stiffness while at the same time being of light weight. Inasmuch as the magnitude of the counterbalance mass as disposed adjacent the upper edge of the door increases at the greater rate in proportion to any increase in the structural weight of the door, known canopy-type doors have accordingly not possessed the desired strength in view of the necessity of maintaining a minimum door weight. Many of these known canopy-type doors have thus been unable to withstand large panel loads thereon, such as caused by heavy winds which often exist in hurricane areas. However, this sacrifice in door strength was believed necessary in order to maintain the door weight at an acceptable magnitude. This lack of door strength has, however, greatly restricted the geographical utilization of doors of this type, and has also made these doors more subject to warpage.

Known canopy-type doors also are somewhat difficult to move into a fully closed position, particularly if a motor-driven operator is not utilized. When the door closely approaches its closed vertical position, the counterweight is located substantially directly above the hinge axis, while the weight of the door is effectively located below the hinge axis. Thus, there is very little unbalanced weight which is effective for urging the door into its fully closed position. Such doors will thus often reach a location which, while closely adjacent the fully closed position, will nevertheless be slightly spaced therefrom. Also, in these known doors, the counterweight does not provide a material force in the closing direction for holding the door in its closed position. Further, there was no provision for adjustment in the counterweight or the position of the hinge axis relative thereto in order to adapt the door to variations in the vertical dimension of the door opening, which adjustments could be made at the job site.

Another disadvantage of known one-piece canopy-type doors is the rather large structural rail members which are normally provided along the lower edge of the door to provide the necessary strength against bowing or warping. This heavy structural rail member along the lower edge of the door was believed necessary in order to transmit the panel loads to the side members. Further, when doors of greater width were desired, such as a double-width door, then the weight and size of this bottom rail member was still further increased. Additional trussing was also often added to the door, thereby resulting in an extremely heavy door having substantial weight adjacent the bottom edge thereof in widely spaced relation from the hinge axis. This thus creates a very undesirable weight factor and accordingly requires the use of an extremely large counterweight mass.

A further disadvantage in known one-piece canopy-type doors is the problem caused by the collection of rain and snow on the top of the door when in an open position. Most known doors of this type do not possess adequate structure for permitting proper drainage of water, whereby substantial quantities of water tend to collect on the opened door. This substantially effects the balance of the door and, when the door is closed, causes the door to close much faster than desired. This can cause injury to the person operating the door, and can also result in water being dumped onto the operator.

Thus, it is an object of the present invention to provide an improved, one-piece, counterbalanced canopy-type closure member, particularly a garage door construction, which substantially overcomes the above-mentioned disadvantages.

More particularly, it is an object of the present invention to provide:

1. An improved door construction, as aforesaid, which utilizes an improved counterbalance container fixedly secured to the door along the upper edge thereof, which container is of smaller cross-section to permit a counterbalance mass to be raised relative to the hinge axis without increasing the vertical height of the door so as to permit a substantial reduction in the counterbalance mass without any effective decreasing in the counterbalance moment.

2. A door construction, as aforesaid, wherein the counterbalance container and part of the mass therein projects outwardly a slight distance beyond the front face of the door to create a counterbalance moment which, when the door is closely adjacent its vertical closed position, urges the door into its closed position.

3. A door construction, as aforesaid, which has the hinge axis carried by heavy support plates fixed to and extending downwardly from the opposite ends of the counterbalance container to provide substantially increased strength and rigidity, while permitting the door to be of minimum weight.

4. A door construction, as aforesaid, having an improved side rail structure which eliminates the need to notch the ends of the face panels to be inserted into a channel-like tie member, which structure also eliminates the need for caulking by permitting the edges of the face panels to be inserted against a resilient weatherstrip positioned in the bottom of the channel-like member.

5. A door construction, as aforesaid, which utilizes one or more, and preferably at least two, vertical load-carrying channels disposed between and substantially parallel to the side rails, which channels at their upper ends are fixedly connected to the counterweight container and project downwardly therefrom as a cantilevered beam. These vertical channels permit the loads as imposed on the door panel to be transmitted from the bottom to the top thereof, so that the bottom rail can be of mimimum size and weight, while at the same time substantially heavy loads (for example, hurricane winds) can be imposed on the door panel since the door effectively acts as a cantilevered beam which is fixed to and projects downwardly from the counterweight container.

6. A door construction, as aforesaid, wherein the side rails and the vertical channels are each of a tapered decreasing cross-section as they project away from the counterweight container so that the door strength progressively decreases toward the lower free edge of the door to result in the door having optimum strength yet minimum weight. More importantly, this tapered structure minimizes the weight which is located furthest from the hinge axis so that the size of the counterbalance mass can be minimized.

7. A door construction, as aforesaid, wherein drainage channels are provided along the opposite sides of the door for permitting the water which tends to collect on the top of the opened door to be drained to the front edge of the door for discharge exteriorly of the building, whereby the build-up of water on the door is effectively prevented.

8. A door construction, as aforesaid, which while normally designed as an eight foot wide door, can also be used as a sixteen foot wide door by removing the adjacent side rails from two eight foot doors and replacing same by vertical channels, which vertical channels are then secured together, thereby resulting in a wide door having the desired strength and rigidity. This structure, also decreases the problem of transporting the door, while at the same time permits an efficient and inexpensive assembly of the wide door at the job site.

Other objects and purposes of the present invention will be apparent to persons familiar with doors of this general type upon reading the following specification and inspecting the accompanying drawings.

Figure 1:
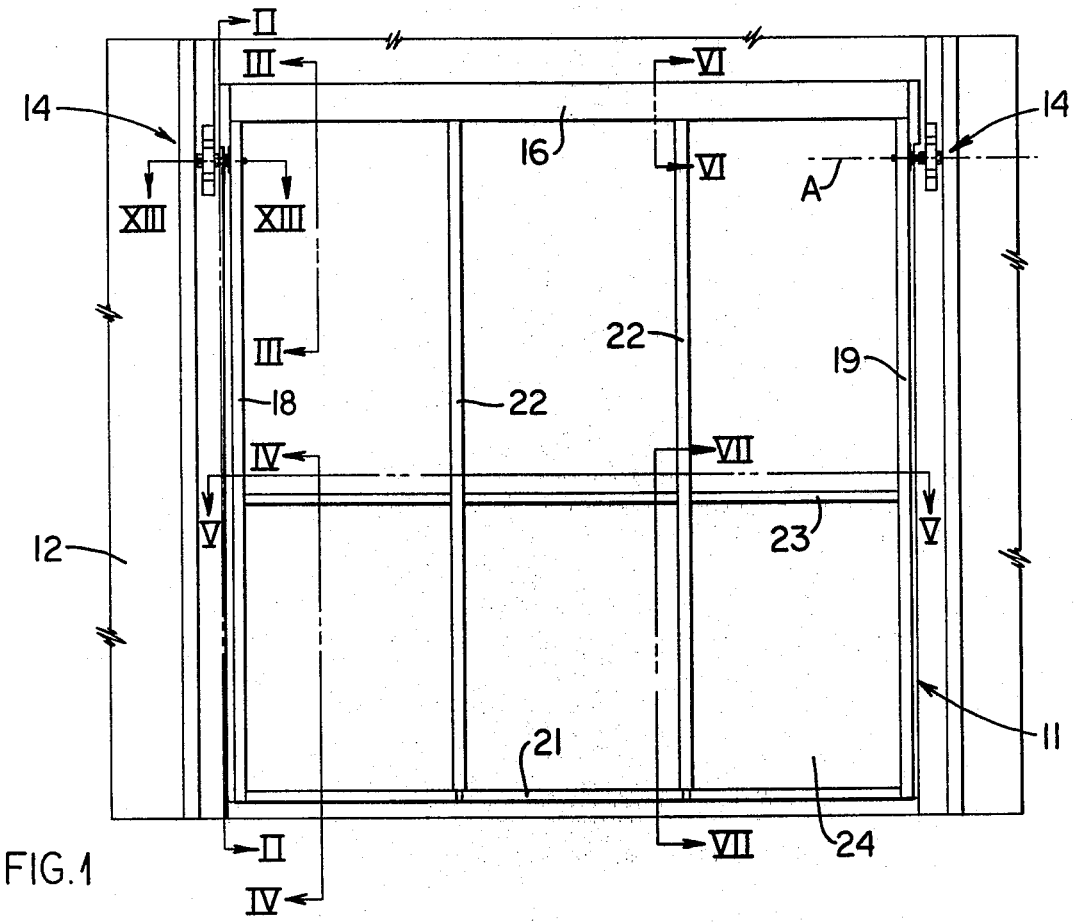
FIG. 1 is an elevational view of the inside of the door when in its closed vertical position.

Certain terminology will be used in the following description for convenience in reference only and will not be limiting. For example, the words "upwardly", "downwardly", "rightwardly" and "leftwardly" will refer to directions in the drawings to which reference is made. The terms "outside" and "inside" shall refer to the sides of the door which are respectively located outside and inside the associated building, which sides are respectively on the left and right sides in FIG. 2. The words "inwardly" and "outwardly" will respectively refer to directions toward and away from the geometric center of the door and designated parts thereof. Said terminology will include the words specifically mentioned, derivatives thereof and words of similar import.

SUMMARY OF THE INVENTION

The objects and purposes of the present invention, including those mentioned above, have been met by providing a one-piece counterbalanced canopy-type door having a counterbalance tube fixed to and extending along the upper edge of the door, which tube has a counterbalance mass of selected magnitude therein. The counterbalance tube is of a substantially rectangular cross-section and has a width which is greater than its height so that the center of gravity of the counterbalance mass is located closely adjacent the door. The counterbalance tube and mass project outwardly beyond or overhang the front face of the door to thereby provide a counterbalance moment which assists in closing the door when the door is closely adjacent its closed vertical position. The structural strength of the door is provided by a pair of substantially Z-shaped side rails which are fixed to the counterbalance tube and project downwardly therefrom in parallel relationship. A pair of intermediate channel members are also fixed to the counterbalance tube and project downwardly therefrom in parallel relationship to the side rails. The side rails and channel members are all of decreasing tapered cross-section and have the front panels secured thereto so that the rails and channel members function as cantilevered beams for permitting the panel load to be transmitted directly to the counterbalance tube. The opposite ends of the counterbalance tube are connected to support plates which project downwardly and support the hinge members thereon. The Z-shaped side rails have panel tie members mounted on the front sides there, which tie members terminate in channel-like portions which receive therein the vertical edges of the front panel. A resilient weatherstrip is positioned in the bottom of each channel-like section for creating a sealed engagement with the edge of the front panel. These tie members also define closed channel-like troughs which extend along the vertical edges of the door on the inside thereof for receiving the water which collects on the front face of the door when it is in an open position, which troughs discharge the water at a location adjacent the lower end of the door.

DETAILED DESCRIPTION

Figure 2:
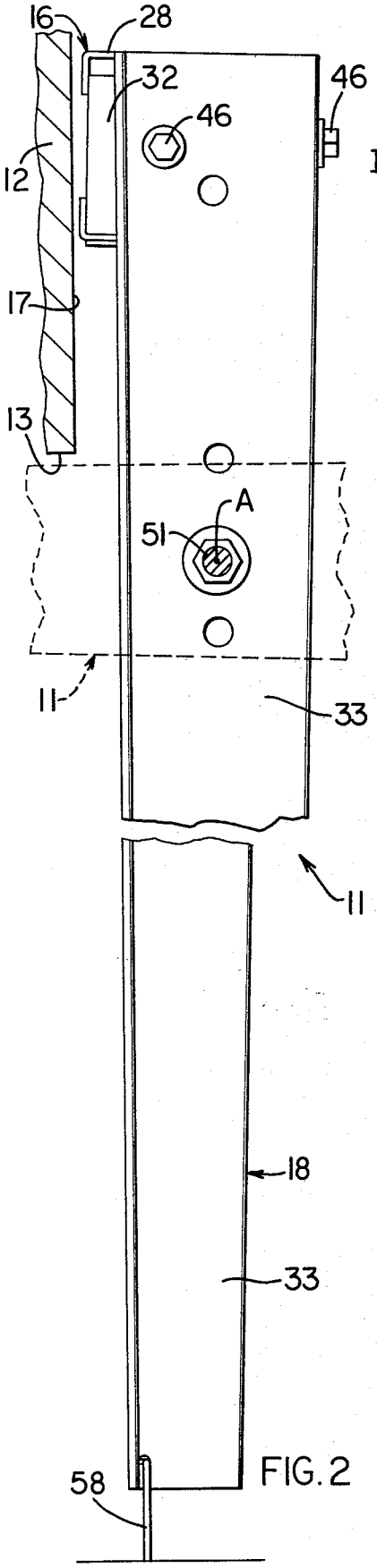
FIGS. 2, 3, 4, 5, 6 and 7 are fragmentary sectional views taken along the lines II—II, III—III, IV—IV, V—V, VI—VI and VII—VII, respectively, in FIG. 1.

FIG. 1 illustrates therein an improved, one-piece, counterbalance canopy-type door 11 according to the present invention. The door 11, which normally comprises a garage door, is associated with a wall 12 having a door opening 13 (FIG. 2) therethrough. Hinge mechanisms 14 are mounted on the opposite sides of the door and cooperating with stationary walls which define the opposite sides of the door opening 13 for permitting the door to be swingably moved about a horizontal hinge axis A between a closed substantially vertical position as shown in FIGS. 1 and 2, and an opened substantially horizontal position wherein the door is disposed closely adjacent the upper edge of the door opening and projects outwardly therefrom as fragmentarily illustrated by dotted lines in FIG. 2. This general type of door is well known.

As illustrated in FIGS. 1 and 2, the door 11 is provided with a counterbalance structure 16 extending along the upper edge thereof, which counterbalance structure is adapted to be disposed closely adjacent the inside surface 17 of the wall 12 at a location above the opening 13 when the door is in its closed position. A pair of substantially Z-shaped side rails 18 and 19 extend along the opposite edges of the door and are fixedly joined by a substantially horizontal bottom rail 21 which defines the lower edge of the door. A plurality of vertical load-carrying members 22, two such members being illustrated in FIG. 1, are disposed between and in parallel relationship to the side rails. The vertical members 22 have their opposite ends fixedly connected to the counterbalance structure 16 and the bottom rail 21. A horizontal cross-brace 23 extends between and is fixedly connected to the opposite side rails 18 and 19, which cross-brace 23 is located approximately midway between the hinge axis A and the bottom rail 21. The rails 18 and 19, the members 22, the rail 21 and the brace 23 thus define a cantilevered framework which is fixed to and projects downwardly from the counterbalance structure 16. This framework is covered by an exterior panel 24 (FIG. 3) which defines the outer surface of the door. The panel 24 is somewhat conventional in that it is of a lightweight sheet material, preferably sheet aluminum, and has a plurality of stiffening channels 26 formed therein and extending horizontally of the panel to provide increased strength and rigidity.

Considering now the counterbalance structure 16, same includes an elongated counterbalance container or tube 28 (FIG. 3) fixed to and extending longitudinally along the upper edge of the door. The tube 28 is of a substantially rectangular cross section and defines therein a compartment 29 in which is disposed a suitable counterweight mass 31. The tube 28 is, in the illustrated embodiment, formed from a first U-shaped member 28A, the free ends of which are suitably fixedly connected by a plurality of plates 28B extending therebetween and welded thereto. The plates 28B are suitably spaced apart to provide openings for insertion of the counterweight mass 31. The counterweight mass 31 may be of many different forms, and may comprise blocks, bricks or pieces of steel, etc. The tube 28 has a vertical height which is less than the horizontal width, and the tube is additionally positioned so that it projects outwardly beyond and thus overhangs the front exterior surface of the door as defined by the panel 24. This thus results in the center of gravity of the counterbalance structure 16 being positioned slightly forwardly from a vertical plane passing through the pivot axis A so that the counterbalance structure thus assists in closing the door when the door approaches its closed vertical position, such as during approximately the last 5° of swinging movement.

The opposite ends of the counterbalance tube 28 are substantially closed by end plates 32 which are fixedly connected thereto, as by welding.

These end plates 32 are in turn overlapped by the upper ends of the Z-shaped side rails 18 and 19, which side rails are identical except for being mirror images of one another. Thus, only the side rail 18 will be described in detail.

Figure 8:
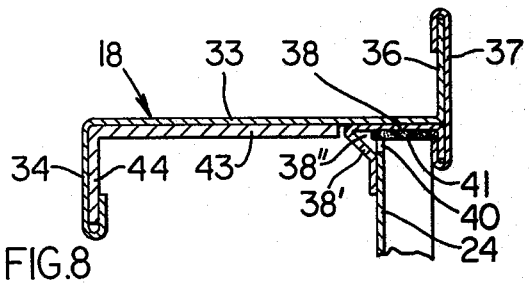
FIG. 8 is a fragmentary sectional view taken along the line VIII—VIII in FIG. 3.
Figure 9:
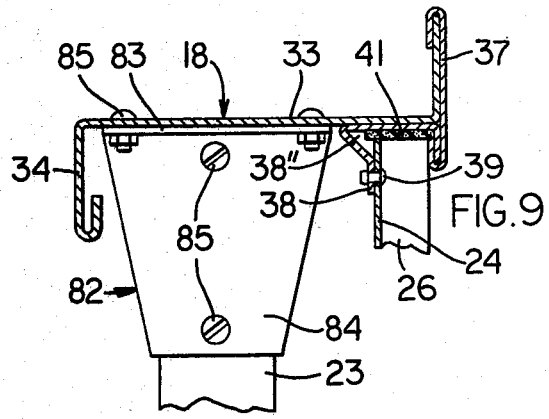
FIGS. 9, 10 and 11 are fragmentary sectional views along the lines IX—IX, X—X and XI—XI, respectively, in FIG. 4.
Figure 10:
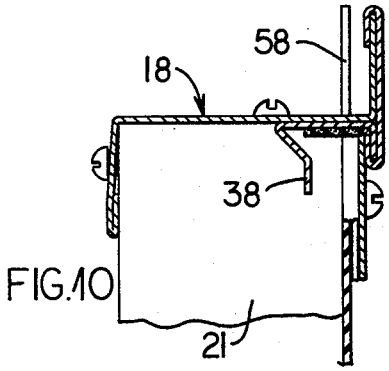

As shown in FIGS. 8–10, the side rail 18 includes a central web plate 33 which extends across the width of the door and effectively defines the side edge thereof. This web plate 33 terminates in rear and front legs 34 and 36, respectively, which legs extend perpendicularly outwardly from the web plate adjacent the opposite ends thereof and in opposite directions. The rear leg is of a rolled channel-shaped configuration to provide the side rail with increased strength.

The front leg 36 has a panel tie member 37 fixedly mounted thereon, which tie member is elongated and extends throughout the length of the side rail 18. The tie member 37 has the outer end thereof wrapped around the free edge of the front leg 36 for securely connecting the two members together. The tie member 17 is additionally formed with a channel-shaped portion 38 on the inner end thereof, which channel-shaped portion 38 opens inwardly of the door and is disposed directly adjacent the inner side of the web 33. The channel portion 38 is of sufficient width to snugly accommodate therein the vertical edge of the front panel 24. The front panel 24 and the tie member 37 are in turn fixedly connected at spaced locations therealong, as by rivets 39. The channel portion 38 also has a flat elastomeric weatherstrip 41 disposed therein and extending longitudinally therealong, which weatherstrip is deformed by and sealingly engages the edge of the panel 24 to create a sealed relationship, thereby eliminating the need to putty or caulk the edge of the panel. Channel portion 38 also has a troughlike part 38′ extending longitudinally thereof and cooperating with the interior surface of the front panel 24 for defining an interior drain passage 38″ which extends vertically of the door along the interior thereof directly adjacent the side rail 18. This drain passage 38″ communicates with the front side of the door panel 24 through a plurality of small openings 40 (FIG. 8) which are vertically spaced apart along the edge of the door. This passage 38″ is open at the lower end of the door for permitting the discharge of water which collects therein.

The front leg 36 also functions as a stop member for defining the closed position of the door. For this purpose, the wall is provided with a stop member 42 (FIG. 13) fixedly associated therewith, which stop member projects outwardly into the door opening 13 and is disposed for engagement with the leg 36 when the door is closed. The leg 36 and its cooperation with the stop member 42 thus defines the closed position of the door, and also create a weatherseal between the door and the wall. As will be appreciated, the stop member 42 extends longitudinally along the side of the opening 13 from a location disposed adjacent the floor to a location disposed adjacent the hinge axis A. The region above the hinge axis A is free of the stop member to permit free swinging movement of the door into its opened horizontal position.

Figure 13:
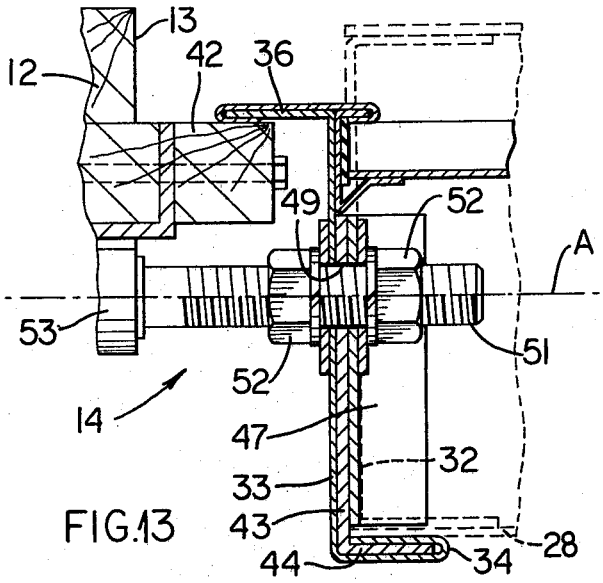
FIG. 13 is an enlarged, fragmentary sectional view along the line XIII—XIII in FIG. 1.

The upper end of each side rail 18 and 19, in the vicinity of the counterbalance tube 28, is additionally provided with a support plate 43 fixedly associated therewith. The support plate 43 is disposed directly adjacent and overlies the inside surface of the web plate 33, as shown in FIG. 13, and terminates in a rear flange 44 which is snugly accommodated within the channel-shaped rear leg 34. The support plate 43 projects upwardly so as to overlap the end plate 32 of the counterbalance tube 28, whereby the support plate 43 is sandwiched between the plates 32 and 33. The side rail 18, support plate 43 and counterbalance tube 28 (or end plate 32) are fixedly connected by suitable fasteners 46, such as bolts. The support plate 43 extends downwardly of the side rail beyond the hinge axis A and terminates at a location spaced intermediate the ends of the side rail. The support plate 43 preferably has a length in the order of approximately ¼ to ⅓ the overall length of the rail 18.

Figure 3:
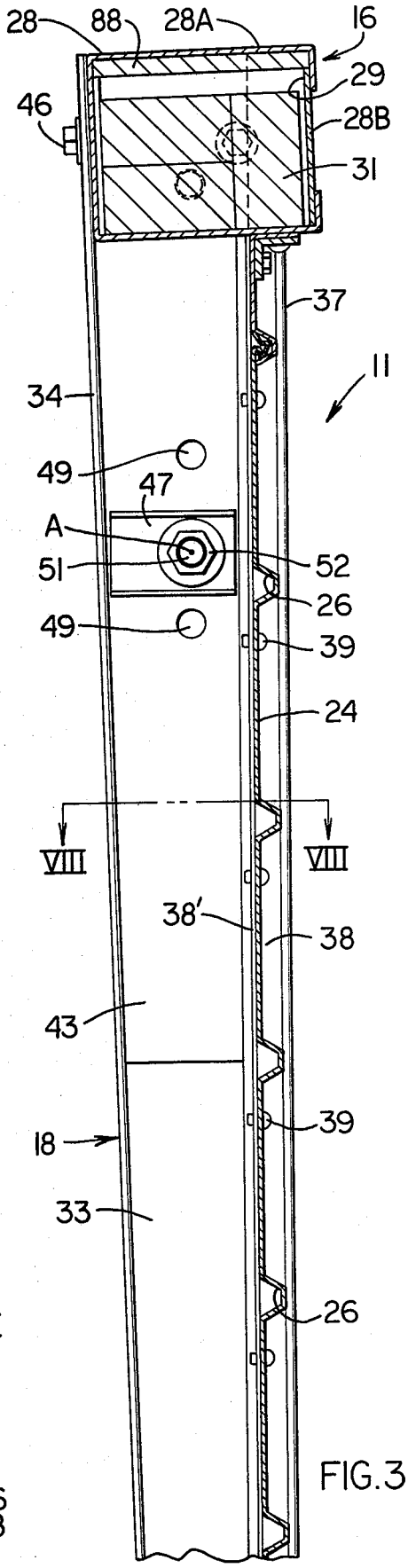

To provide additional support at the hinge mechanism 14, there is provided a channel member 47 which, as shown in FIGS. 3 and 13, is positioned adjacent the inside surface of the plate 43. The member 32 has an opening therethrough which is adapted to be aligned with one of several openings 49 as formed through the plates 33 and 43. A threaded rod 51 extends through these openings and is fixed by means of shouldered nuts 52 (FIG. 13). The threaded rod 51, which defines the horizontal hinge axis A, projects outwardly and has the outer free end thereof rotatably supported within a conventional bearing 53 which is secured to the wall 12. The plate 47 and the connection which it provides between the hinge mechanisms 14 and the side rails 18 and 19, thus permits the efficient transfer of forces between the hinges and the counterbalance structure.

As indicated in FIG. 3, the side rails 18 and 19 preferably have several vertically spaced openings 49 formed therethrough so that a selected one of these openings can be utilized for receiving the hinge rod 51, thereby permitting the door to be selectively positioned depending upon the nature of the installation. This is particularly desirable in situations where a low headroom is available, in which case the hinge rod can be moved upwardly and positioned through the upper opening 49 if desired.

Figure 4:
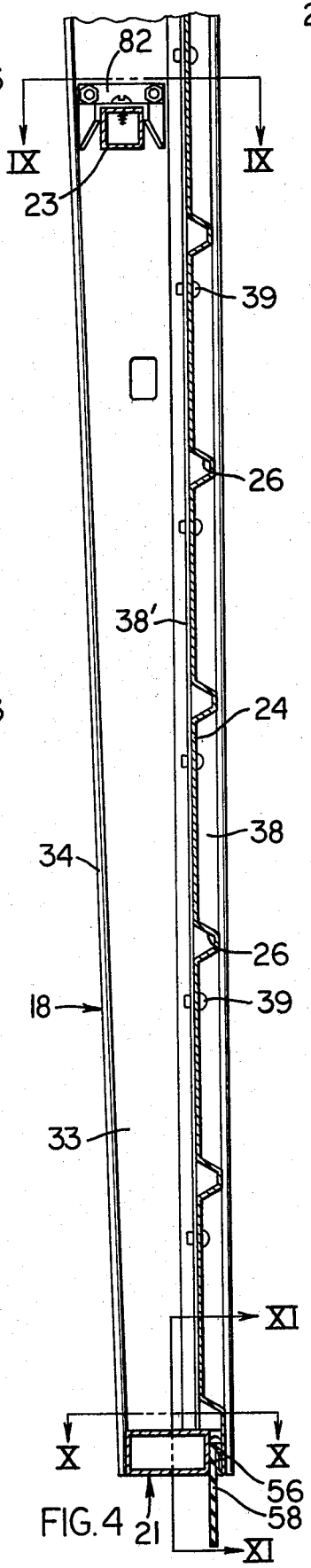

The lower edge of the door has the bottom rail 21 extending therealong which, as shown in FIG. 4, is of a tubular configuration. The upper edge of an elongated flexible weatherstrip 58, which weatherstrip 58 extends longitudinally along the complete lower edge of the door, is fixedly clamped between the bottom rail 21 and the bottom part 56 of the front panel 24.

Figure 11:
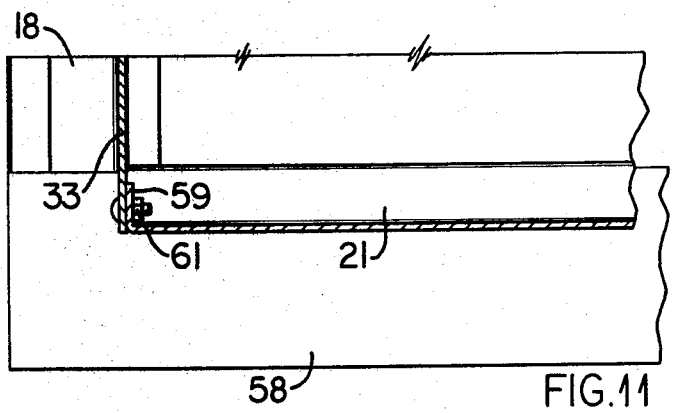

The bottom rail 21, as indicated in FIG. 11, has an upwardly bent tab 59 formed on each end thereof, which tab 59 is secured by a fastening device 61, such as a bolt, to the web plate 33 of the side rails 18 and 19.

Figure 6:
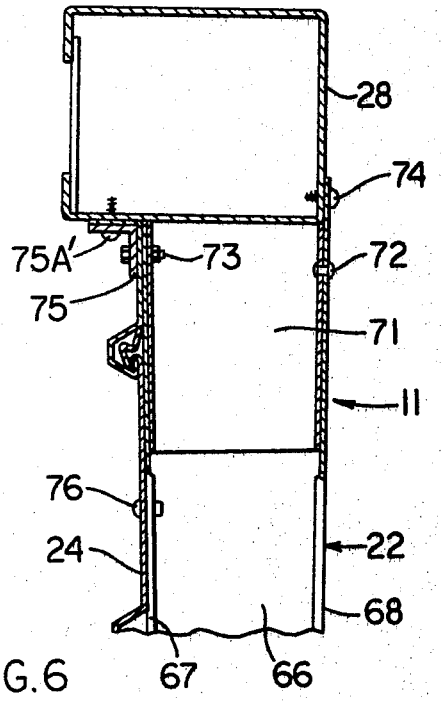
Figure 12:
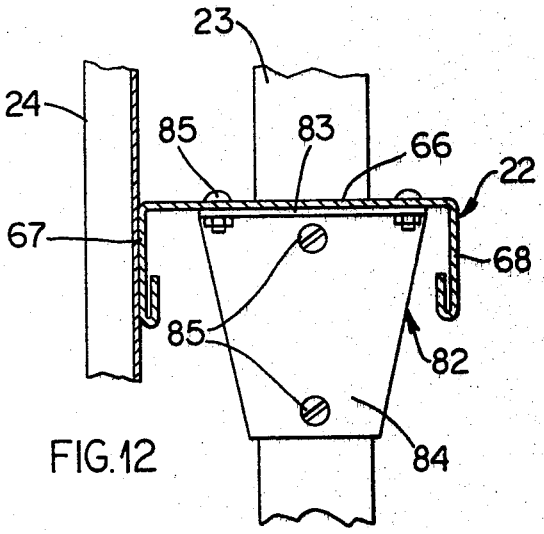
FIG. 12 is a fragmentary sectional view taken along the line XII—XII in FIG. 7.
Figure 5:
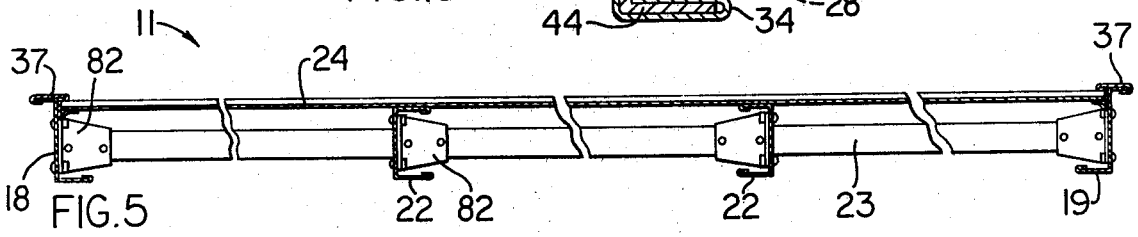

Considering now the vertical load-carrying members 22, these members are disposed between and extend parallel with the side rails 18 and 19 and are fixedly connected to and between the counterbalance tube 28 and the bottom rail 21. The members 22 are of a channel-shaped configuration and, as shown in FIG. 5, open sidewardly in opposite directions. The channel member 22 includes a web plate 66 (FIG. 12) which terminates in front and rear legs 67 and 68, respectively, each of which has a rolled channel-like edge to increase the strength of the member. The upper end of each channel member 22 is reinforced by means of an intermediate bracket 71 (FIG. 6). The bracket 71 is of a substantially channel-shaped configuration and is snugly received within the channel member 22, with the legs of the bracket and the legs of the channel member being suitably fixed together, as by rivets 72 and bolts 73. The channel member 22 has the rear leg thereof projecting upwardly in overlapping relationship with the rear wall of the tube 28, and being fixedly secured thereto by a threaded fastening device 74, such as a screw. The front side of the channel member 22 is also fixed to the tube 28, and for this purpose the bolt 73 also fixedly connects the channel member to not only the top part of the front panel 24, but also to an angle member 75 which extends longitudinally along the torque tube 28 and is fixed thereto by a threaded screw 75A.

The front legs 67 of the channel members 22 are disposed so as to extend transversely across and bear against the front panel 24. Further, rivets 76 can be utilized for connecting the panel 24 to the front legs 67 if desired. The lower end of each channel 22 has a horizontal flange or tab 77 (FIG. 7) which is disposed in engagement with the top web of the bottom rail 21, with the rail 21 and tab 77 being fixedly connected, as by bolts 78.

Figure 7:
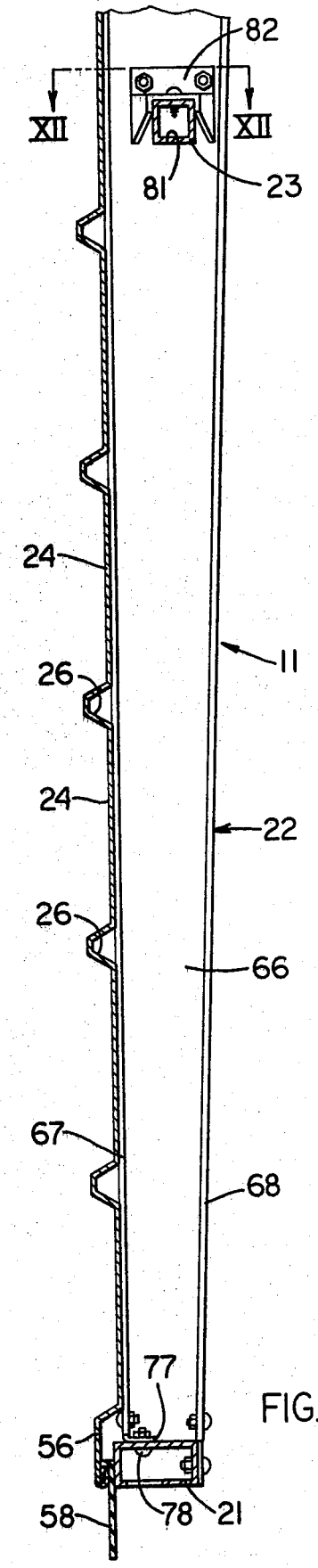

The vertical channels 22 are also fixedly connected to the horizontal cross-brace 23 which, as shown in FIG. 7, is of a tubular cross-section. This cross-brace 23 extends through an opening 81 which is formed in the web 66 of channel member 22. An angle member 82 (FIGS. 7 and 12) fixedly connects the cross-brace 23 to each vertical channel 22. Angle member 82 has perpendicularly projecting flanges 83 and 84 which overlie the web 66 of channel 22 and the top wall of brace 23, respectively, and are fixed thereto, as by threaded fasteners 85.

Each end of the cross-brace 23 is also fixedly connected to the web 33 of the adjacent side rail 18 or 19 by a further angle member 82.

As is apparent from FIGS. 2–4 and 6–7, the side rails 18 and 19 and the vertical channels 22 are all of a tapered configuration such that the cross-section of these members progressively decreases as the members project downwardly from the counterbalance tube 28 to the bottom rail 21. Thus, the strength of the vertical load-carrying members, namely the side rails and the intermediate channels, thus progressively decreases as they project toward the lower end of the door, which decrease in strength is thus somewhat proportional to the stresses imposed on these rails due to the externally applied loads. This configuration of the vertical load-carrying members 18, 19 and 22 thus greatly minimizes the overall weight of the door. The weight is further minimized by forming these rails from lightweight material, such as aluminum. The horizontal rails 21 and 23, and the front panel 24, are also preferably formed of lightweight metal, such as aluminum.

Where a substantial increase in the counterbalance moment is desired, then this can be provided by increasing the counterbalance mass, as by adding the mass 88 (FIG. 3) thereto. This additional mass 88 may comprise a steel plate which can be positioned within the tube 28 directly adjacent the upper wall thereof, whereupon the mass 88 is spaced a maximum distance from the hinge axis A to produce the maximum counterbalance moment.

The operation of a canopy-type door, such as the door 11 of the present invention, is well known in that the door can be readily swingably moved from the closed vertical position shown in FIG. 2 into an open horizontal position as shown by dotted lines in FIG. 2, which swinging movement occurs in a clockwise direction about the axis A. During a majority of the opening swinging movement, the counterbalance structure 16 imposes a clockwise moment about the axis A which tends to counterbalance the counterclockwise moment created by the weight of that portion of the door located between the hinge axis A and the bottom rail 21. This same relationship also exists during the closing movement of the door. However, as the door closely approaches its closed position, such as during approximately the last 5° of angular movement, then the center of gravity of the counterbalance structure 16 passes over center, that is it passes through the vertical plane which contains therein the hinge axis A. Thus, the counterbalance structure 16, due to its overhanging the front face of the door, thus exerts a slight counterclockwise moment about the axis A in FIG. 2 which urges the door into its fully closed position. The counterbalance structure 16 thus normally urges the door away from its closed position during approximately 85° of swinging movement as measured from the open position, which open position is spaced approximately 90° from the closed position. However, the counterbalance structure creates a closing moment during approximately the last 5° of closing movement to thus assist in totally closing the door, and holding the door closed.

When the door is in its opened overhead position, any water which tends to collect on the upwardly facing front panel 24 between the stiffening ribs 26 flows through the small openings 40 into the drain passages 38''. Since the door when in its open position normally slopes slightly downwardly toward its lower end, the water within the drain passages 38'' flows toward the bottom rail 21, whereupon the water flows out through the open lower ends of the drain troughs and is discharged below the door exteriorly of the building. This thus prevents water from accumulating on the top of the door and destroying the balance of the door, either when in its open position or when being swingably moved between its open and closed positions.

In order to swing the door between the open and closed positions, this can be accomplished by a person pulling outwardly on the door near the lower edge thereof so as to open the door and pulling downwardly on the lower edge of the door so as to close the door. On the other hand, the door can be provided with a motor-driven automatic operator for opening and closing the door if desired. One such automatic operator suitable for use with doors of this type is disclosed in U.S. Pat. No. 3,591,981.

Figure 15:
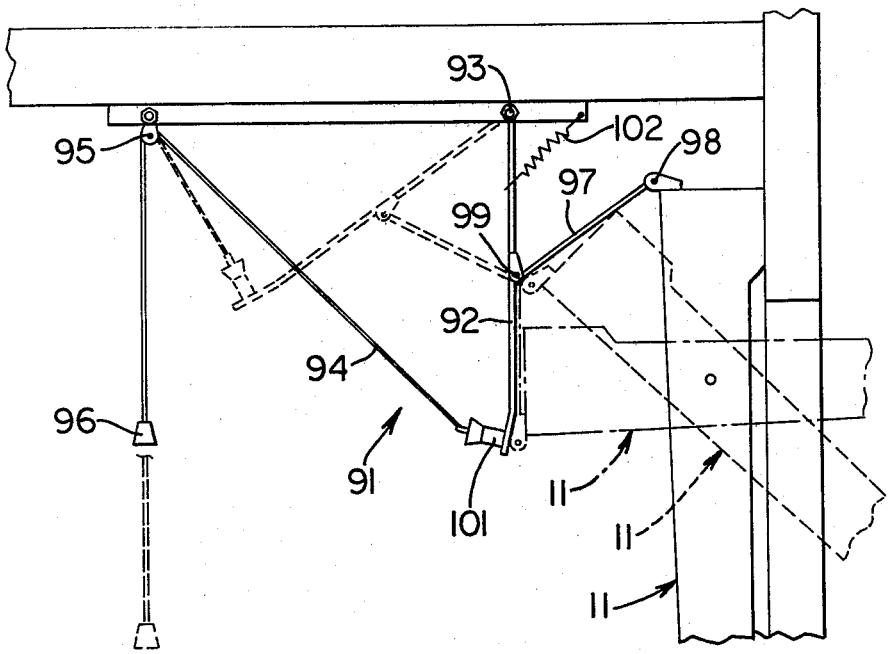
FIG. 15 is a fragmentary view showing an improved operator for permitting manual control of the door movement, and specifically showing the operator and door in several different positions.

FIG. 15 illustrates therein an improved operator 91 according to the present invention for permitting manual actuation of the door between its open and closed positions. The operator 91 includes an elongated lever 92 which is hinged at 93. This hinge 93 is fixedly positioned at a location which is spaced inwardly and substantially coplanar with the upper edge of the closed door. The lower end of lever 92 is connected to one end of a flexible actuating cable 94, which cable extends around a guide pulley 95 which is spaced rearwardly from the hinge 93, with the cable being provided with a gripping knob 96 on the free end thereof. An actuating rod 97 is hingedly connected between the door and the lever 92. Specifically, one end of rod 97 is hinged at 98 to the upper edge of the door, and the other end of rod 97 is hinged at 99 to the lever 92, which hinge 99 is located intermediate the ends of the lever 92.

In actuating the door by means of the operator 91, such as by moving the door from the closed position into its open position, the gripping knob 96 is manually pulled downwardly so as to initiate the upward swinging movement of the door. This downward pulling on the knob 96 continues until the door reaches approximately a 45° position, substantially as illustrated by dotted lines in FIG. 15. At this point, the counterbalance on the door effectively takes over and automatically moves the door upwardly into its open overhead position. During this last approximate 45° swinging of the door into its open position, which open position is also indicated by dotted lines in FIG. 15, the door causes the gripping knob 96 to be pulled upwardly due to the lever 92 being returned from the leftward dotted position into the rightward position of FIG. 15. Thus, the operator can control this opening movement of the door by exerting a downward force on the knob 96 which limits its upward movement, whereby the operator can thus effectively brake the upward swinging movement of the door as it approaches its fully open position. The operator 91, when the door is in its fully opened position, is thus positioned in substantially the same orientation as when the door is closed, except for the rod 97 which overlies the lever 92 when the door is in its opened position. When it is desired to close the door, knob 96 is again pulled downwardly so as to swing the door downwardly into approximately its 45° position, after which the weight of the door will again automatically swing it into its closed position. During this last approximate 45° swinging movement into its closed position, the knob 96 is again pulled upwardly so that the person can again exert a downward force thereon which will effectively brake the closing movement of the door.

As shown in FIG. 15, a counterweight 101 is mounted on the lever 92 adjacent the free end thereof, which counter weight thus ensures that the lever 92 is normally returned into its substantially vertically suspended position substantially as shown by solid lines. In place of the counterweight 101, a compression spring 102 can be connected to the lever 92 for controlling the position thereof as desired.

When the door is in the open position the hinge point 99 is slightly offset and inward from points 93 and 98, thus causing the door to lock open until released by pulling on knob 96. To provide a more positive lock and to prevent lever 92 from being bounced out of this offset position, the offset weight 101 or tension spring 102 can be used.

The operator 91 thus provides very desirable control over the swinging movement of the door, whether in the opening or closing direction. At the same time, the operator is spaced inwardly from the door so that the operator is not only protected by the building but is also positioned so that the operator can not be accidentally struck by the swinging door.

While the door of the present invention, as illustrated in FIGS. 1–13, is normally manufactured as a single-width door which is conventionally about 8 feet in width, nevertheless the door structure of this invention is also highly desirable for wider doors, such as double doors having a width of about 16 feet. Such a double-width door is illustrated in FIG. 14, which double-width door can be manufactured from two single-width doors of the type described above.

Figure 14:
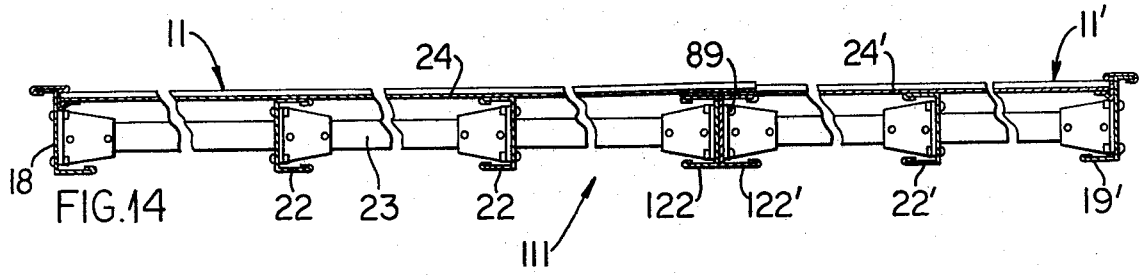
FIG. 14 is a broken sectional view similar to FIG. 5 but illustrating the connection of two eight-foot doors so as to form a double width door, such as a conventional sixteen-foot door.

FIG. 14 illustrates a double-width door 111 which is formed from two substantially identical single-width doors designated 11 and 11'. The doors 11 and 11' are substantially identical except that the adjacent Z-shaped side rails have been removed and replaced by vertical load-carrying channel members 122 and 122', which members are identical to the channel members 22 described above. The channel members 122 and 122' are positioned so that they are spaced slightly inwardly from the adjacent vertical edge of the front panels 24 and 24', respectively. The two doors 11 and 11' are then positioned in side-by-side relationship so that the channels 122 and 122' are disposed in abutting engagement. In this position, the panels 24 and 24' slightly overlap one another. The channels 122 and 122' are then suitably fixedly connected together, as by bolts 89, thereby effectively forming an H-shaped beam which extends vertically down the center of the door and is positioned directly behind the overlapping panels 24 and 24'. The overlapping panels 24 and 24' can then be suitably fixedly connected to the legs of the channels 122 and 122', as by rivets. With this double-door structure, the counterbalance tube 28 and bottom rail 21 can be fixedly spliced together to effectively form continuous elements which extend across the complete width of the door. In the alternative, a long one-piece tube 28 and bottom rail 21 can be provided, which elements can be installed on the job site.

Although a particular preferred embodiment of the invention has been disclosed above for illustrative purposes, it will be understood that variations or modifications thereof which lie within the scope of the appended claims are fully contemplated.

The embodiments of the invention in which an exclusive property or privilege is claimed are defined as follows:

1. In a one-piece canopy-type door construction which is swingable about a substantially horizontal pivot axis between a closed position wherein the door is substantially vertical and an open position wherein the door is substantially horizontal, the improvement comprising:

a counterbalance structure fixed to and extending along the upper edge of said door, said counterbalance structure including a tubelike member extending across the upper edge of said door and defining therein a compartment, and counterbalance mass means positioned within said compartment;

cantilevered frame means fixed to said counterbalance structure and projecting outwardly therefrom, said frame means including a pair of elongated, substantially parallel, load-carrying side rails which are fixed to said tubelike member adjacent the opposite ends thereof and project outwardly therefrom for defining the opposite sides of said door, said side rails being fixedly connected adjacent their free ends by a substantially horizontally extending bottom rail;

said frame means further including at least two elongated, load-carrying intermediate members disposed between and substantially parallel with said side rails, said intermediate members being spaced from one another and having the upper ends thereof structurally fixedly connected directly to said tubelike member at longitudinally spaced intervals intermediate the ends of said tubelike member, whereby each said immediate member functions as a load-carrying cantilevered beam for transferring loads longitudinally thereof directly to said tubelike member, and the other end of each intermediate member being fixedly connected to said bottom rail;

panel means fixed to and overlying said frame means for defining the exterior face of said door, said panel means extending horizontally between said side rails and extending from said bottom rail to said tubelike member; and hinge means associated with each of said side rails for defining said horizontal pivot axis, said hinge means being located closely adjacent but spaced downwardly from the upper edge of said door.

2. A door construction according to claim 1, including manually actuable operator means connected to said door for controlling the swinging movement thereof between said open and closed positions, said operator means including an operating lever disposed for swinging movement about a fixed axis which is spaced inwardly from the inner surface of the door and is positioned at an elevation similar to the upper edge of the door when it is in said closed position, an elongated flexible actuating member connected to said operating lever at a location disposed of substantial distance from said fixed axis, said flexible actuating member having means associated with the other end thereof for permitting same to be manually gripped so that a tension force can be imposed thereon, and an elongated connecting member having the opposite ends thereof hingedly connected to said operator lever and said door adjacent the upper edge thereof.

3. A door structure according to claim 1, wherein each of said intermediate load-carrying members has a bracket fixedly associated with the upper end thereof and fixedly connected directly to said tubelike member for rigidly securely connecting the upper end of said load-carrying member to said tubelike member, said bracket projecting downwardly into and overlapping a portion of said intermediate member for a small distance away from said tubelike member.

4. A door structure according to claim 1, said intermediate load-carrying members each being of a channel-shaped cross section, each of said intermediate load-carrying members and said side rails being of a tapered cross-section which progressively decreases as each side rail and each intermediate member extends from said tubelike member to said bottom rail, said side rails and intermediate members decreasing in overall width as measured in a direction perpendicular to the front surface of said door so that said door has a tapered cross-section which progressively decreases as the door extends from said pivot axis to the lower free edge thereof.

5. A door structure according to claim 4, wherein an intermediate support member is fixed to each said side rail adjacent the upper end thereof, said intermediate support member extending throughout only a small fraction of the overall length of said side rail, said support member extending from adjacent the upper end of said side rail and terminating at a location disposed below the pivot axis, said side rail and the respective support member each extending upwardly along one end of said tubelike member and being fixedly connected thereto.

6. In a one-piece canopy-type door construction which is swingable about a substantially horizontal pivot axis between a closed position wherein the door is substantially vertical and an open position wherein the door is substantially horizontal, the improvement comprising:

a counterbalance structure fixed to and extending along the upper edge of said door, said counterbalance structure including a tubelike member extending across the upper edge of said door and defining therein a compartment, and counterbalance mass means positioned within said compartment;

cantilevered frame means fixed to said counterbalance structure and projecting outwardly therefrom, said frame means including a pair of elongated, substantially parallel, load-carrying side rails which are fixed to said tubelike member adjacent the opposite ends thereof and project outwardly therefrom for defining the opposite sides of said door, said side rails being fixedly connected adjacent their free ends by a substantially horizontally extending bottom rail;

said frame means further including at least one elongated, load-carrying intermediate member disposed between and substantially parallel with said side rails, said intermediate member having one end therof fixedly connected to said tubelike member and the other end thereof fixedly connected to said tubelike member and the other end thereof fixedly connected to said bottom rail;

panel means fixed to and overlying said frame means for defining the exterior face of said door, said panel means extending horizontally between said side rails and extending from said bottom rail to said tubelike member;

said side rails each having an inwardly opening channel-shaped section associated therewith and extending longitudinally thereof adjacent the exterior side of the door, said side rail also including a substantially Z-shaped structural element having a substantially platelike web portion and front and rear leg portions fixed to and projecting transversely from opposite sides of said plate-like web portion adjacent the opposite edges thereof, said front leg portion having a panel tie member extending thereover and fixedly connected thereto, said panel tie member terminating in said channel-shaped section which is disposed adjacent the inner surface of said platelike web portion, and fastening means extending between said panel tie member and said panel means for fixedly connecting same together; and hinge means associated with each of said side rails for defining said horizontal pivot axis, said hinge means being located closely adjacent but spaced downwardly from the upper edge of said door.

7. A door construction according to claim 6, said channel-shaped sections having elastomeric and compressible sealing strips disposed in the bottoms thereof throughout the length of the channel-shaped sections, and said panel means having the side edges thereof positioned within said channel-shaped sections and disposed in engagement with said elastomeric strips for creating a sealed engagement between said panel means and the adjacent side rails.

8. A door structure according to claim 7, wherein said channel-shaped section includes a troughlike part extending longitudinally along the side rail, said troughlike part being disposed closely adjacent the interior surface of said panel means and cooperating therewith to define an elongated drain passage, said panel means having opening means formed therein and extending therethrough and communicating directly with said drain passage, and said drain passage being opened adjacent said bottom rail for permitting discharge of water therefrom.

9. In a one-piece canopy-type door construction which is swingable about a substantially horizontal pivot axis between a closed position wherein the door is substantially vertical and an open position wherein the door is substantially horizontal, the improvement comprising:

a counterbalance structure fixed to and extending along the upper edge of said door, said counterbalance structure including a tubelike member extending across the upper edge of said door and defining therein a compartment, and counterbalance mass means positioned within said compartment;

cantilevered frame means fixed to said counterbalance structure and projecting outwardly therefrom, said frame means including a pair of elongated, substantially parallel, load-carrying side rails which are fixed to said tubelike member adjacent the opposite ends thereof and project outwardly therefrom for defining the opposite sides of said door, said side rails being fixedly connected adjacent their free ends by a substantially horizontally extending bottom rail;

said frame means further including at least one elongated, load-carrying intermediate member disposed between and substantially parallel with said side rails, said intermediate member having one end thereof fixedly connected to said tubelike member and the other end thereof fixedly connected to said bottom rail;

panel means fixed to and overlying said frame means for defining the exterior face of said door, said panel means extending horizontally between said side rails and extending from said bottom rail to said tubelike member;

hinge means associated with each of said side rails for defining said horizontal pivot axis, said hinge means being located closely adjacent but spaced downwardly from the upper edge of said door; and said counterbalance structure having the center of gravity thereof, when the door is in a closed vertical position, positioned between the exterior front surface of the door as defined by said panel means and a vertical plane passing through said pivot axis, whereby said counterbalance structure acting through said center of gravity imposes a moment on said door which urges said door into said closed position when said door is adjacent said closed position.

10. A door according to claim 9, wherein the center of gravity of said counterbalance structure is spaced upwardly above said pivot axis when said door is closed so that said center of gravity passes over onto the other side of said vertical plane after said door has been swingably moved through a small angular extent away from said closed position.

11. A door according to claim 10, wherein said tubelike member is of a substantially rectangular cross section and has a first cross-sectional dimension as measured along the height of the door which is less than a second cross-sectional dimension as measured across the width of the door, and wherein said tubelike member projects outwardly beyond the front surface of the door as defined by said panel means so that the center of gravity of said counterbalance structure is displaced forwardly of said vertical plane when said door is closed.

12. In a one-piece canopy-type door construction which is swingable about a substantially horizontal pivot axis between a closed position wherein the door is substantially vertical and an open position wherein the door is substantially horizontal, the improvement comprising:

a counterbalance structure fixed to and extending along the upper edge of said door, said counterbalance structure including a tubelike member extending across the upper edge of said door and defining therein a compartment, and counterbalance mass means positioned within said compartment;

cantilevered frame means fixed to said counterbalance structure and projecting outwardly therefrom, said frame means including a pair of elongated, substantially parallel, load-carrying side rails which are fixed to said tubelike member adjacent the opposite ends thereof and project outwardly therefrom for defining the opposite sides of said door, said side rails being fixedly connected adjacent their free ends by a substantially horizontally extending bottom rail;

said frame means further including at least one elongated, load-carrying intermediate member disposed between and substantially parallel with said side rails, said intermediate member having one end thereof fixedly connected to said tubelike member and the other end thereof fixedly connected to said bottom rail;

panel means fixed to and overlying said frame means for defining the exterior face of said door, said panel means extending horizontally between said side rails and extending from said bottom rail to said tubelike member;

hinge means associated with each of said side rails for defining said horizontal pivot axis, said hinge means being located closely adjacent but spaced downwardly from the upper edge of said door; and drain means for permitting water which collects on the door when in its open position to be discharged adjacent the bottom edge of the door, said drain means including channel-like means extending substantially between the upper and lower ends of the door and defining an interior drain passage which is open at the end thereof adjacent the bottom rail for permitting discharge of the water therefrom, said channel means comprising an elongated channel-like part positioned directly adjacent and extending longitudinally along each side rail and disposed for coaction with the inside surface of the panel means for defining said interior passage, and said panel means having a plurality of small openings formed therethrough for direct communication with said interior passage.

13. In a one-piece canopy-type door construction which is swingable about a substantially horizontal pivot axis between a closed position wherein the door is substantially vertical and an open position wherein the door is substantially horizontal, the door being of double-width and being formed from two single-width door units, the improvement comprising:

a first single-width door unit of substantially rectangular configuration and including frame means having exterior panel means fixed thereto and overlying same for defining the exterior face of said door unit, said frame means including an elongated load-carrying side rail disposed adjacent one side edge of said door unit, said frame means including at least two elongated load-carrying intermediate beams extending parallel to said side rail, said intermediate beams being spaced from one another and spaced inwardly from the opposite side edges of said door unit, and said frame means also including a channel-shaped edge beam disposed directly adjacent the other side edge of said door unit and extending substantially parallel to said side rail, said channel-shaped edge beam opening inwardly of said door unit;

a second door unit which is identical to said first door unit but is a mirror image thereof;

said first and second door units being positioned in adjacent side-by-side relationship so that the other side edges of said first and second door units are disposed directly adjacent one another, whereby the edge beams of said first and second units are positioned in back-to-back relationship, and fastener means for rigidly securing the edge beams of said first and second door units together so as to form a composite I-beam, whereby the rigidly joined together first and second door units thus form a composite double-width door;

a counterbalance structure fixed to and extending along the upper edge of said double-width door, said counterbalance structure including elongated tubelike means extending across the upper edge of said double-width door and defining therein a compartment, said tubelike means being fixedly and structurally secured to the upper ends of said side rails, said intermediate beams and said edge beams, and counterbalance mass means positioned within said compartment; and hinge means associated with each of said side rails for defining said horizontal pivot axis, said hinge means being located closely adjacent but spaced downwardly from the upper edge of said double-width door.

14. A horizontally-hinged door construction comprising:

one-piece panel means of rectangular configuration having a hinge axis near to, parallel with and spaced from the upper edge of said panel means;

wall means defining an elongated counterweight chamber integral with said panel means and extending lengthwise along said upper edge thereof, said wall means projecting beyond the front face of said panel means;

counterweight means disposed within said chamber, the center of gravity of said counterweight means moving across top dead center relative to said hinge axis as said door is moved into a closed position; and a pair of rigid side elements rigidly secured to the opposite ends of said wall means and extending downwardly therefrom along the edges of said panel means through said hinge axis, the lower ends of said rigid side elements being secured to the adjacent edges of said panel means.

15. A door construction according to claim 14, including means for permitting the hinge axis of said panel means to be adjusted lengthwise along said rigid elements; and wherein said counterweight means is comprised of a plurality of rectangular weights and an elongated relatively heavy weight positionable between said plurality of rectangular weights and the upper side of said chamber.

* * * * *